US007018770B1

(12) United States Patent
Dickerson et al.

(10) Patent No.: US 7,018,770 B1
(45) **Date of Patent: *Mar. 28, 2006**

(54) HIGH SPEED REFLECTIVE RADIOGRAPHIC MATERIAL

(76) Inventors: Robert E. Dickerson, Eastman Kodak Company, 343 State St., Rochester, NY (US) 14650; Kenneth A. Duke, Eastman Kodak Company, 343 State St., Rochester, NY (US) 14650; Phillip C. Bunch, Eastman Kodak Company, 343 State St., Rochester, NY (US) 14650; Alan S. Fitterman, Eastman Kodak Company, 343 State St., Rochester, NY (US) 14650

( * ) Notice: Subject to any disclaimer, the term of this patent is extended or adjusted under 35 U.S.C. 154(b) by 0 days.

This patent is subject to a terminal disclaimer.

(21) Appl. No.: 11/091,609

(22) Filed: Mar. 28, 2005

(51) Int. Cl.
*G03C 5/16* (2006.01)
*G03C 1/80* (2006.01)

(52) U.S. Cl. ..... 430/139; 430/350; 430/496; 430/567; 430/617; 430/618; 430/619; 430/620; 430/966; 430/967

(58) Field of Classification Search ..... 430/139, 430/350, 496, 567, 617–620, 966–967
See application file for complete search history.

(56) References Cited

U.S. PATENT DOCUMENTS

| | | | | |
|---|---|---|---|---|
| 2005/0100838 | A1* | 5/2005 | Dickerson et al. | 430/496 |
| 2005/0100840 | A1* | 5/2005 | Dickerson et al. | 430/496 |
| 2005/0100841 | A1* | 5/2005 | Dickerson et al. | 430/496 |

OTHER PUBLICATIONS

U.S. Appl. No. 11/091,049, filed herewith, titled *Method of Processing Silver Halide Materials.* , by A.S. Fitterman et al.
U.S. Appl. No. 11/091,601 filed herewith, titled *Reflective Radiographic Material with Incorporated Developer,* by R.E. Dickerson et al.

* cited by examiner

*Primary Examiner*—Geraldine Letscher
(74) *Attorney, Agent, or Firm*—J. Lanny Tucker

(57) ABSTRACT

A reflective radiographic material is useful to provide images that can be viewed without a light box. This reflective radiographic material has a reflective support and a silver halide emulsion on one side of the support only. The material can be used with a single green- or blue-light emitting fluorescent intensifying screen as part of an imaging assembly. The reflective support enables the image in the radiographic material to be viewed without a light box and the speed of the material enables the use of low power X-radiation generating equipment.

18 Claims, No Drawings

HIGH SPEED REFLECTIVE RADIOGRAPHIC MATERIAL

FIELD OF THE INVENTION

This invention is directed to radiography. In particular, it is directed to a high-speed radiographic material that provides medical diagnostic images on a reflective support.

BACKGROUND OF THE INVENTION

In conventional medical diagnostic imaging, the object is to obtain an image of a patient's internal anatomy with as little X-radiation exposure as possible. The fastest imaging speeds are realized by mounting a duplitized radiographic element between a pair of fluorescent intensifying screens for imagewise exposure. About 5% or less of the exposing X-radiation passing through the patient is adsorbed directly by the latent image forming silver halide emulsion layers within the duplitized radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.), U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and U.S. Pat. No. 5,576,156 (Dickerson), and *Research Disclosure*, Vol. 184, August 1979, Item 18431.

Problem to be Solved

The earliest radiographic elements typically comprised a silver halide emulsion coated on a single side of a glass substrate. More recently, radiographic elements or materials described and used in the art have traditionally contained various silver halide emulsion layers coated on a transparent film support (often coated on both sides) so the resulting images can be viewed using light boxes. However, in many remote parts of the world, light boxes are not available, thereby severely limiting the usefulness of traditional radiographic elements.

Chest radiography is one of the most common uses of radiographic imaging in the world. However, because of the nature of the organs in the chest cavity, imaging has been limited to using high-powered, fixed installation X-radiation generating equipment. Based on an American College of Radiology ("ACR") clinical practice standard, chest radiography should be performed at exposure times less than 40 milliseconds (less than 15 milliseconds for pediatric patients). This is necessary in order to stop the motion of the beating heart and adjacent blood vessels as well as to stop the motion of the surrounding lung tissues (respiration-induced motion and cardiac motion). While most patients can hold their breath for a brief time, the most critically ill patients cannot do so, further exacerbating this problem.

Additionally, a 10:1, 103 line/mm anti-scatter grid is recommended by the ACR in order to reduce scattered radiation, putting additional stress on the X-radiation exposure system. An unusually long X-radiation tube focus-film distance of 72 inches (178 cm) (40 inches or 102 cm for portable exams) is recommended in order to minimize X-radiation tube focal spot image blur. This long focus-film distance reduces the intensity of the X-radiation beam to about 25% of its normal intensity, further limiting the utility of low-powered X-radiation units. A radiographic system speed of 200 is recommended, based on existing commonly available screen/film/processing technology.

Given these standardized exposure conditions and radiographic technique considerations, inexpensive (low-powered) x-ray generators cannot produce clinically acceptable, motion-artifact-free chest radiographs using available screen-radiographic film systems that have unacceptably low system speed.

For imaging systems with substantially reduced image blur and high speed, experience has taught us that high system speed and high clinical image quality are not mutually exclusive.

In addition, for imaging systems with the primary advantage of very high speed, reducing or eliminating concerns about patient motion during radiographic exposures with low-powered X-radiation equipment will make clinically useful chest radiography a practical examination for the first time with such equipment. Currently, the only solution to this problem is to use full-powered X-radiation generators that are not affordable in most of the developing countries of the world.

In addition, in many parts of the world, there is insufficient electrical power to generate X-radiation using traditional imaging machines and such high power X-radiation generators are usually located in "fixed" installation and not portable into remote regions.

Thus, high-powered X-radiation generating equipment is not generally available in situations such as mobile military radiography, field veterinary medicine, on-site sports radiography, and some industrial/security radiography where portability and low electrical power requirements are essential. In these and other applications, very high speed screen-film materials are critical to the ability of the radiographic systems to make a properly exposed radiograph and stop patient motion by using short exposure times with limited X-radiation tube output.

Thus, there is a need to find a means to provide meaningful radiographic imaging and diagnostics without the need for a light box so the image can be viewed under ambient lighting. In addition, it would be useful to find a way to accurately and effectively image patients with minimal X-radiation exposure using low power X-radiation generators for radiographic uses including chest radiography.

SUMMARY OF THE INVENTION

This invention provides a reflective radiographic material having a speed of at least 200 and comprising a reflective support that has first and second major surfaces, the reflective radiographic material having disposed on the first major reflective support surface only, one or more hydrophilic colloid layers including a silver halide emulsion layer.

In preferred embodiments, a reflective radiographic material has a speed of at least 800 and comprises a reflective resin-coated paper support that has first and second major surfaces, the reflective radiographic material having disposed on the first major reflective support surface, two or more hydrophilic colloid layers including a single silver halide emulsion layer, the single silver halide emulsion layer comprising tabular silver halide grains that have an aspect ratio of from about 25 to about 40, an average grain diameter of from about 2.5 to about 4.5 μm, and an average thickness of from about 0.07 to about 0.11 μgm, and comprise at least 95 mol % bromide and up to 1 mol % iodide, both based on total silver in the grains, the material optionally comprising a protective overcoat disposed over all of the hydrophilic colloid layers, wherein the tabular silver halide grains in the silver halide emulsion layer are dispersed in a hydrophilic polymeric vehicle mixture comprising from about 0.1 to about 1.5% of deionized oxidized gelatin, based on the total dry weight of the hydrophilic polymeric vehicle mixture, the coverage of silver in the silver halide emulsion layer is from about 15 to about 18 mg/dm$^2$ and the polymer vehicle coverage in the silver halide emulsion layer on the first major reflective support surface of from about 38 to about 40 mg/dm$^2$.

This invention also provides an imaging assembly that has a system speed of at least 200 and comprises:

A) a radiographic material of this invention, and

B) a fluorescent intensifying screen or storage phosphor panel arranged on the imaging side of the radiographic material, the screen or panel having a screen speed of at least 100 and comprising an inorganic phosphor capable of absorbing X-rays and emitting electromagnetic radiation having a wavelength greater than 300 nm, the inorganic phosphor being coated in admixture with a polymeric binder in a phosphor layer onto a support.

Further, a method of providing a black-and-white image comprises processing an exposed reflective radiographic material of this invention to provide a black-and-white image. Exposure of the reflective radiographic material can be accomplished using a single fluorescent intensifying screen. The resulting black-and-white images in the processed reflective radiographic material can be used for a medical diagnosis.

In particular, the present invention provides a high-speed radiographic material that can be imaged using low-power X-radiation generating machines (that is, those using less than 130 kVp power source of X-radiation) and the resulting image can be viewed and used in ambient light (that is, without a light box). Such low-power imaging machines can be more readily used in remote parts of the world, mobile radiography, field veterinary medicine, at sporting events, or other sites where conventional high-power imaging machines are unavailable or inconvenient. These advantages are achieved by replacing the traditional transparent film supports of radiographic films with a "reflective" support. In addition, the silver halide emulsion(s) are present on a single side of this reflective support and are designed to have higher photographic speed so that lower radiation dosage can be used to provide useful images. While the minimum overall system speed is at least 200, preferably the system speed is at least 800 and more preferably at least 1600.

DETAILED DESCRIPTION OF THE INVENTION

Definition of Terms:

Unless otherwise indicated, the terms "radiographic imaging assembly", "imaging assembly", and "radiographic material", and "reflective radiographic material" refer to embodiments of the present invention.

The term "contrast" as herein employed refers to the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2-\log_{10}E_1$), $E_1$ and $E_2$ being the exposure levels at the reference points (1) and (2).

"Gamma" is used to refer to the instantaneous rate of change of a density vs. logE sensitometric curve (or instantaneous contrast at any logE value).

"System speed" refers to a measurement given to combinations ("systems" or imaging assemblies) of radiographic silver halide material and fluorescent intensifying screen that is calculated using the conventional ISO 9236-1 standard wherein the radiographic material is exposed and processed under the conditions specified in Eastman Kodak Company's Service Bulletin 30. In general, system speed is thus defined as 1 milliGray/$K_S$ wherein $K_S$ is Air Kerma (in Grays) required to achieve a density=1.0+$D_{min}$+fog. In addition, 1 milliRoentgen (mR) is equal to 0.008732 milliGray (mGray). For example, by definition, if 0.1 milliGray (equal to 11.4 mR) incident on a film-screen system creates a density of 1.0 above $D_{min}$+fog, that material-screen system is considered to have a speed of "10".

However, it is common in the trade to use a "scaled" version of system speed, wherein commercially available KODAK Min-R 2000 radiographic film used in combination with a commercially available KODAK Min-R 2000 intensifying screen is assigned or designated a speed value of "150". Bunch et al. *SPIE Medical Imaging*, Vol. 3659 (1999), pp. 120–130 shows that it requires 6.3 mR for such a KODAK Min-R 2000 film/screen system to reach a density of 1.0 above $D_{min}$+fog. This gives an ISO speed value of 18.1 for this particular system. Thus, the relationship between the ISO speed value and the common definition of system speed is the ratio 150/18.1=8.25. That is, the numerical values of the common system speed values are 8.25 times those directly obtained using equation 7.1 of the noted ISO 9236-1 standard.

The "scaled" system speed values common in the trade are used in this application. However, they can be converted to ISO speed values by dividing them by 8.25.

In this application, "film speed" is in reference to the reflective radiographic material of this invention. Film speed has been given a standard of "150" for a commercially available KODAK Min-R 2000 radiographic film that has been exposed for 1 second and processed according to the Service Bulletin 30 using a fluorescent intensifying screen containing a terbium activated gadolinium oxysulfide phosphor (such as Screen X noted below in the Example). Thus, if the $K_S$ value for a given system using a given radiographic film is 50% of that for a second film with the same screen and exposure and processing conditions, the first film is considered to have a speed 200% greater than that of the second film. This commercially available film as also been described as Film A in U.S. Pat. No. 6,037,112 (Dickerson).

Also in this application, "screen speed" has been given a standard of "150" for a conventional KODAK Min-R 2000 screen containing a terbium activated gadolinium oxysulfide phosphor. Thus, if the $K_S$ value for a given system using a given screen with a given radiographic film is 50% of that for a second screen with the same film and exposure and processing conditions, the first screen is considered to have a speed 200% greater than that of the second screen. The KODAK Min-R 2000 fluorescent intensifying screen identified above contains a terbium activated gadolinium oxysulfide phosphor (median particle size of about 3.8 to 4.0 μm) and 10 ppm (based on total phosphor weight) of finely divided carbon (0.1 to 0.5 μm) dispersed in a Permuthane U6366™ polyurethane binder on a blue-tinted poly(ethylene terephthalate) film support having a thickness of about 180 am. The total phosphor coverage is 3.3 g/dm$^2$ and the phosphor to binder weight ratio is 21:1. The dried thickness of the phosphor layer is about 84 μm phosphor to binder weight ratio is 21:1. The dried thickness of the phosphor layer is about 84 μm. Over the phosphor layer is disposed a protective overcoat layer comprising cellulose acetate and crosslinked polystyrene matte particles present at 3% of the weight of the total overcoat. The overcoat has been coated to a dry thickness of about 6 μm.

The term "duplitized" is used to define a radiographic material having one or more silver halide emulsion layers disposed on both the front- and backsides of the support. The reflective radiographic materials of the present invention are not "duplitized."

In referring to grains and silver halide emulsions containing two or more halides, the halides are named in order of ascending molar concentrations.

The term "equivalent circular diameter" (ECD) is used to define the diameter of a circle having the same projected area as a silver halide grain. This can be measured using known techniques described for example in U.S. Pat. No. 4,425,425 (Abbott et al.).

The term "aspect ratio" is used to define the ratio of grain ECD to grain thickness.

The term "coefficient of variation" (COV) is defined as 100 times the standard deviation (a) of grain ECD divided by the mean grain ECD.

The term "fluorescent intensifying screen" refers to a "prompt" emitting fluorescent intensifying screen that will emit light immediately upon exposure to radiation while "storage" fluorescent screen or storage phosphor panel can "store" the exposing X-radiation for emission at a later time when the screen or panel is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. The publication is also available from Emsworth Design Inc., 147 West 24th Street, New York, N.Y. 10011.

Reflective Radiographic Materials

The reflective radiographic materials have a speed of at least 800 and preferably of at least 1600, and include a reflective support (described below) having disposed on one side only, one or more photographic silver halide emulsion (hydrophilic colloid) layers and optionally one or more non-light sensitive hydrophilic colloid layer(s). Where there are multiple silver halide emulsion layers, their composition, thickness, and sensitometric properties can be the same or different. Preferably, there is a single silver halide emulsion layer on the reflective support.

In most preferred embodiments, the reflective radiographic materials have a single silver halide emulsion layer on one side of the reflective support and a protective overcoat (described below) over it and any other non-light sensitive layers. Thus, at least one non-light sensitive hydrophilic layer is included with the silver halide emulsion layer. This layer may be an interlayer or overcoat, or both types of non-light sensitive layers can be present.

The silver halide emulsion layer(s) can include silver halide grains having any desirable morphology or comprise a mixture of two or more of such morphologies as long as the desired photographic speed is achieved for the radiographic material. The composition and methods of making such silver halide grains are well known in the art.

Preferably, the one or more silver halide emulsion layers comprise predominantly (more than 50%, and preferably at least 70%, of the total grain projected area) tabular silver halide grains. The grain composition can vary among multiple silver halide emulsion layers, but preferably, the grain composition is essentially the same in all silver halide emulsion layers. These tabular silver halide grains generally comprise at least 50, preferably at least 90, and more preferably at least 95, mol % bromide, based on total silver in the particular emulsion layer. Such emulsions include silver halide grains composed of, for example, silver iodobromide, silver chlorobromide, silver iodochlorobromide, and silver chloroiodobromide. The iodide grain content is generally up to 5 mol %, based on total silver in the emulsion layer. Preferably the iodide grain content is up to 3 mol %, and more preferably up to about 1 mol % (based on total silver in the emulsion layer). Mixtures of different tabular silver halide grains can be used in the silver halide emulsion layers.

The tabular silver halide grains used in the silver halide emulsion layers generally have as aspect ratio of 25 or more, preferably of 30 or more and up to 45, and more preferably from about 25 to about 40. The aspect ratio can be the same or different in multiple silver halide emulsion layers, but preferably, the aspect ratio is essentially the same in all layers.

In general, the tabular grains have an average grain diameter (ECD) of at least 2.5 μm, and preferably of from about 2.5 to about 4.5 μM. The average grain diameters can be the same or different in multiple silver halide emulsion layers. At least 100 non-overlapping tabular grains are measured to obtain the "average" ECD.

In addition, the tabular grains generally have an average thickness of from about 0.07 to about 0.12 μm and preferably from about 0.07 to about 0.11 μm. The average thickness can be the same or different but preferably it is essentially the same for multiple silver halide emulsion layers.

The procedures and equipment used to determine tabular grain size (and aspect ratio) are well known in the art.

Tabular grain emulsions that have the desired composition and sizes are described in greater detail in the following patents, the disclosures of which are incorporated herein by reference in relation to the tabular grains:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No.

5,576,168 (Daubendiek et al.), U.S. Pat. No. 5,576,171 (Olm et al.), and U.S. Pat. No. 5,582,965 (Deaton et al.).

A variety of silver halide dopants can be used, individually and in combination, in one or more of the silver halide emulsion layers to improve contrast as well as other common sensitometric properties. A summary of conventional dopants is provided in *Research Disclosure*, Item 38957 [Section I Emulsion grains and their preparation, sub-section D, and grain modifying conditions and adjustments are in paragraphs (3), (4), and (5)].

A general summary of silver halide emulsions and their preparation is provided in *Research Disclosure*, Item 38957 (Section I Emulsion grains and their preparation). After precipitation and before chemical sensitization the emulsions can be washed by any convenient conventional technique using techniques disclosed by *Research Disclosure*, Item 38957 (Section III Emulsion washing).

Any of the emulsions can be chemically sensitized by any convenient conventional technique as illustrated by *Research Disclosure*, Item 38957 (Section IV Chemical Sensitization). Sulfur, selenium or gold sensitization (or any combination thereof) is specifically contemplated. Sulfur sensitization is preferred, and can be carried out using for example, thiosulfates, thiosulfonates, thiocyanates, isothiocyanates, thioethers, thioureas, cysteine, or rhodanine. A combination of gold and sulfur sensitization is most preferred.

In addition, if desired, any of the silver halide emulsions can include one or more suitable spectral sensitizing dyes that include, for example, cyanine and merocyanine spectral sensitizing dyes. The useful amounts of such dyes are well known in the art but are generally within the range of from about 200 to about 1000 mg/mole of silver in the given emulsion layer. It is preferred that all of the silver halide grains used in the present invention (in all silver halide emulsion layers) be "green-sensitized" (spectrally sensitized to radiation of from about 470 to about 570 nm of the electromagnetic spectrum) or "blue-sensitized" (spectrally sensitized to radiation of from about 400 to about 530 nm). Various spectral sensitizing dyes are known for achieving this property. Green-sensitized tabular silver halide grains are most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated in *Research Disclosure*, Item 38957 (Section VII Antifoggants and stabilizers) and Item 18431 (Section II Emulsion Stabilizers, Antifoggants and Antikinking Agents).

It may also be desirable that the silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds are described in U.S. Pat. No. 5,800,976 (Dickerson et al.) that is incorporated herein by reference for the teaching of such sulfur-containing covering power enhancing compounds.

The silver halide emulsion layers and other hydrophilic layers on the reflective support of the radiographic materials generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957 (Section II Vehicles, vehicle extenders, vehicle-like addenda and vehicle related addenda). The emulsions themselves can contain peptizers of the type set out in Section II, paragraph A (Gelatin and hydrophilic colloid peptizers). The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes, polyacrylamides (including polymethacrylamides), and dextrans as described in U.S. Pat. No. 5,876,913 (Dickerson et al.), incorporated herein by reference.

Thin, high aspect ratio tabular grain silver halide emulsions useful in the present invention will typically be prepared by processes including nucleation and subsequent growth steps. During nucleation, silver and halide salt solutions are combined to precipitate a population of silver halide nuclei in a reaction vessel. Double jet (addition of silver and halide salt solutions simultaneously) and single jet (addition of one salt solution, such as a silver salt solution, to a vessel already containing an excess of the other salt) process are known. During the subsequent growth step, silver and halide salt solutions, and/or preformed fine silver halide grains, are added to the nuclei in the reaction vessel, and the added silver and halide combines with the existing population of grain nuclei to form larger grains. Control of conditions for formation of high aspect ratio tabular grain silver bromide and iodobromide emulsions is known, for example, based upon U.S. Pat. No. 4,434,226 (Wilgus et al.), U.S. Pat. No. 4,433,048 (Solberg et al.), and U.S. Pat. No. 4,439,520 (Kofron et al.). It is recognized, for example, that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, U.S. Pat. No. 4,434,226 (Wilgus et al.), for example, teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. U.S. Pat. No. 4,439,520 (Kofron et al.) extends these teachings to the precipitation of high aspect ratio tabular grain silver bromide emulsions. pBr is defined as the negative log of the solution bromide ion concentration. U.S. Pat. No. 4,414,310 (Daubendiek et al.) describes a process for the preparation of high aspect ratio silver bromoiodide emulsions under pBr conditions not exceeding the value of 1.64 during grain nucleation. U.S. Pat. No. 4,713,320 (Maskasky), in the preparation of high aspect ratio silver halide emulsions, teaches that the useful pBr range during nucleation can be extended to a value of 2.4 when the precipitation of the tabular silver bromide or bromoiodide grains occurs in the presence of gelatino-peptizer containing less than 30 micromoles of methionine (for example, oxidized gelatin) per gram. The use of such oxidized gel also enables the preparation of thinner and/or larger diameter grains, and/or more uniform grain populations containing fewer non-tabular grains.

The use of oxidized gelatin as peptizer during nucleation, such as taught by U.S. Pat. No. 4,713,320 (noted above), is particularly preferred for making thin, high aspect ratio tabular grain emulsions for use in the present invention, employing either double or single jet nucleation processes. As gelatin employed as peptizer during nucleation typically will comprise only a fraction of the total gelatin employed in an emulsion, the percentage of oxidized gelatin in the resulting emulsion may be relatively small, that is, at least 0.05% (based on total dry weight).

Thus it is preferred that the coated tabular grain silver halide emulsion layers comprise tabular silver halide grains dispersed in a hydrophilic polymeric vehicle mixture comprising at least 0.05% and preferably at least 0.1% of oxidized gelatin based on the total dry weight of hydrophilic polymeric vehicle mixture in the coated emulsion layer. The upper limit for the oxidized gelatin is not critical but for practical purposes, it is 1.5% based on the total dry weight of the hydrophilic polymer vehicle mixture. Preferably, from about 0.1 to about 1.5% (by dry weight) of the hydrophilic polymer vehicle mixture is oxidized gelatin.

It is also preferred that the oxidized gelatin be in the form of deionized oxidized gelatin but non-deionized oxidized gelatin can be used, or a mixture of deionized and non-deionized oxidized gelatins can be used. Deionized or non-deionized oxidized gelatin generally has the property of relatively lower amounts of methionine per gram of gelatin than other forms of gelatin. Preferably, the amount of methionine is from 0 to about 3 μmol of methionine, and more preferably from 0 to 1 μmol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the reflective radiographic materials are generally fully hardened using one or more conventional hardeners. Thus, the amount of hardener on the one side of the support is generally at least 1% and preferably at least 1.5%, based on the total dry weight of the polymer vehicles.

The levels of silver and polymer vehicle in the reflective radiographic material can vary in the various silver halide emulsion layers. In general, the total amount of silver on the imaging side of the reflective support is at least 13 and no more than 18 mg/dm$^2$ (preferably from about 15 to about 18 mg/dm$^2$). In addition, the total coverage of polymer vehicle (all layers) on the imaging side of the reflective support is generally at least 36 and no more than 40 mg/dm$^2$ (preferably from about 38 to about 40 mg/dm$^2$). These amounts refer to dry weights.

The reflective radiographic materials generally include a surface protective overcoat disposed on the imaging side that typically provides for physical protection of the various layers underneath. The protective overcoat can be subdivided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are described in *Research Disclosure*, Item 38957 (Section IX Coating physical property modifying addenda, A. Coating aids, B. Plasticizers and lubricants, C. Antistats, and D. Matting agents). Interlayers that are typically thin hydrophilic colloid layers can be used to provide a separation between the silver halide emulsion layers and the surface overcoats or between the silver halide emulsion layers. The overcoat can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers.

The various coated layers of radiographic materials can also contain tinting dyes to modify the image tone to reflected light. These dyes are not decolorized during processing and may be homogeneously or heterogeneously dispersed in the various layers. Preferably, such non-bleachable tinting dyes are in one or more silver halide emulsion layers.

In some embodiments, the reflective radiographic materials contain one or more "incorporated black-and-white developing agents" (or reducing agents) that are compounds that can act to reduce silver (I) ion to silver metal. Conventional black-and-white developing agents of this type include aminophenols, polyhydroxybenzenes (such as p-dihydroxybenezenes including hydroquinone and its derivatives), ascorbic acid and its derivatives (see for example U.S. Pat. No. 5,236,816 (Purol et al.) and U.S. Pat. No. 5,738,979 (Fitterman et al.), both incorporated by reference), 3-pyrazolidinones, and phenylenediamines. Hydroquinone and its derivatives are preferred black-and-white developing agents. Mixtures of black-and-white developing agents can be used if desired.

The quantity of black-and-white developing agent in the reflective radiographic material depends upon the silver content of silver halide emulsion layer in which it is located and the reducing agent "strength" of the developing agent. It can be located in the single silver halide emulsion layer, or in one or more of multiple silver halide emulsion layers. Generally, the molar ratio of developer to silver is at least 0.25:1 and preferably it is from about 0.5:1 to about 2:1.

It may also be useful to include one or more "co-developers" in one or more silver halide emulsion layers that may work in association with the black-and-white developing agent to enhance the development process. The co-developer is usually present in a smaller quantity than the black-and-white developing agent with a molar ratio of black-and-white developing agent to co-developer being from about 10:1 to about 300:1, and preferably from about 175:1 to about 250:1.

Useful co-developers include aminophenols [such as p-aminophenol, o-aminophenol, N-methylaminophenyl, 2,4-diaminophenol hydrochloride, N-(4-hydroxyphenyl) glycine, and ELON® (methyl-p-aminophenol sulfate)], 1-phenyl-3-pyrazolidones or phenidones [such as compounds described in U.S. Pat. No. 5,236,816 (noted above) including phenidone-A (1-phenyl-3-pyrazolidone), phenidone-B (1-phenyl-4,4'-dimethyl-3-pyrazolidone), dimezone-S (1-phenyl-4-methyl-4'-hydroxymethyl-3-pyrazolidone)], blocked phenidones, and many other compounds known in the art. A most preferred co-developer is 1-phenyl-4-methyl-4'-hydroxymethyl-3-pyrazolidone.

The black-and-white developing agent and co-developers can be incorporated into the silver halide layer(s) or into an adjacent non-photosensitive layer using procedures known in the art.

Reflective Support

The radiographic materials have a reflective support. By "reflective", we mean a support having a composition or structural arrangement such that it reflects at least 70% of incident light (such as light emitted from a fluorescent intensifying screen). Preferably, at least 80% of incident light is reflected by the support.

Various reflective supports can be used including those used for conventional photographic papers that comprise wood fibers or a cellulosic material that is generally coated with baryta or one or more resins or polymers (such as polyolefins). Either or both the coating or paper can contain various reflective pigments such as titanium dioxide, barium sulfate, zinc sulfate, and others known in the photographic color paper art, antioxidants, optical brighteners and fluorescent materials. Further details about reflective paper supports are provided in *Research Disclosure*, September 1996, Item 38957, paragraph XV and references cited therein. Polyethylene resin-coated photographic papers containing titanium dioxide or zinc oxide pigments are the preferred reflective supports for this invention.

Reflective lenticular supports as described in U.S. Pat. No. 5,013,621 (Kistner et al.) and U.S. Pat. No. 5,075,204 (Shiba et al.) can also be used.

Pigmented polymer supports can also be used including pigmented polyesters, pigmented polystyrene, and pigmented polycarbonates.

In addition, a reflective support can be a single- or multi-layer reflective sheet that is a reflective substrate comprising a "microvoided" continuous polyester first phase and a second phase dispersed within the continuous polyester first phase. This second phase comprises microvoids containing barium sulfate particles.

The continuous polyester first phase of the reflective substrate provides a matrix for the other components of the reflective substrate and is transparent to longer wavelength electromagnetic radiation. This polyester phase can comprise a film or sheet of one or more thermoplastic polyesters, which film has been biaxially stretched (that is, stretched in both the longitudinal and transverse directions) to create the microvoids therein around the barium sulfate particles. Any suitable polyester can be used as long as it can be cast, spun, molded, or otherwise formed into a film or sheet, and can be biaxially oriented as noted above. Generally, the polyesters have a glass transition temperature of from about 50 to about 150° C. (preferably from about 60 to about 100° C.) as determined using a differential scanning calorimeter (DSC). Suitable polyesters include those produced from the reaction of aromatic, aliphatic, or carbocyclic dicarboxylic acids of 4 to 20 carbon atoms and aliphatic or aromatic glycols having 2 to 24 carbon atoms.

Suitable polyesters that can be used in the practice of this invention include, but are not limited to, poly(1,4-cyclohexylene dimethylene terephthalate), poly(ethylene terephthalate), poly(ethylene naphthalate), and poly(1,3-cyclohexylene dimethylene terephthalate). Poly(1,4-cyclohexylene dimethylene terephthalate) is most preferred.

The ratio of the refractive index of the continuous polyester first phase to the second phase is from about 1.4:1 to about 1.6:1.

Barium sulfate particles are incorporated into the continuous polyester phase. These particles generally have an average particle size of from about 0.3 to about 2 μm (preferably from about 0.7 to about 1.0 μM). In addition, these particles comprise from about 35 to about 65 weight % (preferably from about 55 to about 60 weight %) of the total dry reflective substrate weight, and from about 15 to about 25% of the total reflective substrate volume.

The barium sulfate particles can be incorporated into the continuous polyester phase by various means. For example, they can be incorporated during polymerization of the dicarboxylic acid(s) and polyol(s) used to make the continuous polyester first phase. Alternatively and preferably, the barium sulfate particles are mixed into pellets of the polyester and the mixture is extruded to produce a melt stream that is cooled into the desired sheet containing barium sulfate particles dispersed therein.

These barium sulfate particles are at least partially bordered by voids because they are embedded in the microvoids distributed throughout the continuous polyester first phase. Thus, the microvoids containing the barium sulfate particles comprise a second phase dispersed within the continuous polyester first phase. The microvoids generally occupy from about 35 to about 60% (by volume) of the dry reflective substrate.

The microvoids can be of any particular shape, that is circular, elliptical, convex, or any other shape reflecting the film orientation process and the shape and size of the barium sulfate particles. The size and ultimate physical properties of the microvoids depend upon the degree and balance of the orientation, temperature and rate of stretching, crystallization characteristics of the polyester, the size and distribution of the barium sulfate particles, and other considerations that would be apparent to one skilled in the art. Generally, the microvoids are formed when the extruded sheet containing barium sulfate particles is biaxially stretched using conventional orientation techniques.

Further details about such "microvoided" supports are provided in copending and commonly assigned U.S. Ser. No. 10/968,483 (filed Oct. 19, 2004 by Laney and Steklenski).

Still other reflective supports can be similarly prepared using a "microvoided" poly(lactic acid) instead of a "microvoided" polyester as described in U.S. Pat. No. 6,836,606 (Laney et al.).

The reflective support can have a thickness (dry) of from about 150 to about 190 μm (preferably from about 170 to about 190 μm).

Imaging Assemblies

A radiographic imaging assembly is composed of one reflective radiographic material as described herein and one fluorescent intensifying screen arranged on the imaging side of the reflective radiographic material. The imaging assembly has a cumulative system speed of at least 200 (preferably at least 1600 and more preferably at least 3200) for the entire "system". The reflective radiographic material and fluorescent intensifying screen can be arranged in a suitable "cassette" designed for this purpose. Fluorescent intensifying screens are typically designed to absorb X-rays and to promptly emit electromagnetic radiation having a wavelength greater than 300 nm. These screens can take any convenient form providing they meet all of the usual requirements for use in radiographic imaging. Examples of conventional, useful fluorescent intensifying screens and methods of making them are provided in *Research Disclosure*, Item 18431 (Section IX X-Ray Screens/Phosphors) and U.S. Pat. No. 5,021,327 (Bunch et al.), U.S. Pat. No. 4,994,355 (Dickerson et al.), 4,997,750 (Dickerson et al.), and 5,108,881 (Dickerson et al.), the disclosures of which are here incorporated by reference. The fluorescent layer contains prompt-emitting phosphor particles dispersed in a suitable binder, and may also include a light scattering material, such as titania.

Any prompt-emitting phosphor can be used, singly or in mixtures, in the intensifying screens. The phosphors can be either blue-light or green-light emitting phosphors but the green-light emitting phosphors are preferred for most embodiments of the invention. For example, useful phosphors are described in numerous references relating to fluorescent intensifying screens, including but not limited to, *Research Disclosure*, Vol. 184, August 1979, Item 18431 (Section IX X-ray Screens/Phosphors) and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 4,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), and U.S. Pat. No. 5,871,892 (Dickerson et al.), and EP 0 491,116A1 (Benzo et al.), the disclosures of all of which are incorporated herein by reference with respect to the phosphors.

The inorganic phosphor can be calcium tungstate, activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described in U.S. Pat. No. 4,988,880 (Bryan et al.), U.S. Pat. No. 4,988,881 (Bryan et al.), 4,994,205 (Bryan et al.), 5,095,218 (Bryan et al.), 5,112,700 (Lambert et al.), 5,124,072 (Dole et al.), and 5,336,893 (Smith et al.), the disclosures of which are all incorporated herein by reference.

Alternatively, the inorganic phosphor is a rare earth oxychalcogenide and oxyhalide phosphors and represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Th), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides or oxysulfides (such as $Gd_2O_2S$:Tb).

Other suitable phosphors are described in U.S. Pat. No. 4,835,397 (Arakawa et al.) and U.S. Pat. No. 5,381,015 (Dooms), both incorporated herein by reference, and include for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting phosphors such as barium fluorobromide.

Another class of useful phosphors includes rare earth hosts such as rare earth activated mixed alkaline earth metal sulfates such as europium-activated barium strontium sulfate.

Other useful phosphors are alkaline earth metal phosphors that can be the products of firing starting materials comprising optional oxide or a combination of species as characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Th), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is form 0 to 1, and "t" is from 0 to 0.01. These definitions apply wherever they are found in this application unless specifically stated to the contrary. It is also contemplated that "M", "X", "A", and "D" represent multiple elements in the groups identified above.

The phosphor can be dispersed in a suitable binder(s) in a phosphor layer. A particularly useful binder is a polyurethane binder such as that commercially available under the trademark Permuthane.

The fluorescent intensifying screens useful in this invention exhibit a photographic "screen" speed of at least 100, preferably of at least 400 and more preferably of at least 600. One preferred green-light emitting phosphor is a terbium activated gadolinium oxysulfide. Preferred blue-light emitting phosphors include calcium tungstate and barium fluorobromide. A skilled worker in the art would be able to choose the appropriate inorganic phosphor, its particle size, emission wavelength, and coverage in the phosphor layer to provide the desired screen speed and other desired properties.

Support materials for fluorescent intensifying screens and storage phosphor panels include cardboard, plastic films such as films of cellulose acetate, polyvinyl chloride, polyvinyl acetate, polyacrylonitrile, polystyrene, polyester, polyethylene terephthalate, polyamide, polyimide, cellulose triacetate and polycarbonate, metal sheets such as aluminum foil and aluminum alloy foil, ordinary papers, baryta paper, resin-coated papers, pigmented papers containing titanium dioxide or the like, and papers sized with polyvinyl alcohol or the like. A flexible plastic film is preferably used as the support material.

In addition, the support can be a "microvoided support" as described in more detail in U.S. Pat. No. 6,836,606 and U.S. Ser. No. 10/968,483, now U.S. Patent Application Publication 2005-0098738.

The plastic film may contain a light-absorbing material such as carbon black, or may contain a light-reflecting material such as titanium dioxide or barium sulfate. The former is appropriate for preparing a high-resolution type radiographic screen, while the latter is appropriate for preparing a high-sensitivity screen. It is highly preferred that the support absorbs substantially all of the radiation emitted by the phosphor. Examples of preferred supports include polyethylene terephthalate, blue colored or black colored (for example, LUMIRROR C, type X30 supplied by Toray Industries, Tokyo, Japan). These supports may have a thickness that may differ depending o the material of the support, and may generally be between 60 and 1000 μm, more preferably between 80 and 500 μm from the standpoint of handling.

Imaging and Processing

Exposure and processing of the reflective radiographic materials can be undertaken in any convenient conventional manner. The exposure and processing techniques of U.S. Pat. Nos. 5,021,327 and 5,576,156 (both noted above) are typical for processing radiographic materials. Exposing X-radiation is generally directed through a patient and then through a fluorescent intensifying screen arranged against the frontside (imaging side) of the radiographic material. The screen then emits suitable radiation in an imagewise fashion to provide the latent image in the reflective radiographic material.

It is advantageous that the imaging assembly comprising the reflective radiographic material and screen has sufficiently high photographic speed that they can be imaged using "low power" and less expensive X-radiation generators. Generally, such X-radiation generators have relatively low, fixed X-radiation tube currents in the range of from about 15 to about 20 milliAmperes (mA) and peak 100–130 kVp voltage, preferably also used combination with an anti-X-ray scatter grid with a grid ratio of 8:1 or higher. In contrast, the typical "fixed installation" high-powered X-radiation generating systems produce 500–1000 mA enabling very short (5–40 milliseconds) patient exposure times for motion-sensitive imaging such as chest radiography.

Processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multipart formulations, and in concentrated form or as more diluted working strength solutions.

It is particularly desirable that the radiographic materials of this invention be processed within 90 seconds ("dry-to-dry") and preferably for at least 20 seconds and up to 60 seconds ("dry-to-dry"), including the developing, fixing, any washing (or rinsing) steps, and drying. Such processing can be carried out in any suitable processing equipment including but not limited to, a Kodak X-OMAT® RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any photographic film hardeners, such as glutaraldehyde.

Where the reflective radiographic material contains an incorporated black-and-white developing agent (and possibly a co-developer), processing can be carried out using simpler processing solutions. For example, the imaged material can be contacted with an activator composition having a pH of at least 10 and at least 0.05 mol/l of sulfite ions, followed by contact with a solution comprising a fixing agent other than a sulfite and no black-and-white developing agent. These two steps can be carried out sequentially, or simultaneously when the activator composition also comprises the fixing agent.

The activator solution generally has a pH of at least 10, preferably at least 11, and more preferably at least 12. The alkalinity of this solution and the presence of sulfite ions "activates" the incorporated black-and-white developing agent in the processed reflective radiographic material. Useful fixing agents include those well known for radiographic film processing. More details concerning the processing of materials containing the incorporated black-and-white developing agent are provided in copending and commonly assigned U.S. Ser. No. 11/091,049 (D-88391) (filed on even date herewith by Fitterman, Dickerson, and Duke), entitled "Method of Processing Silver Halide Materials", incorporated herein by reference.

Radiographic kits can include an imaging assembly, additional fluorescent intensifying screens and/or metal screens, one or more reflective radiographic materials, and/or one or more suitable processing compositions.

The following examples are presented for illustration and the invention is not to be interpreted as limited thereby.

EXAMPLE 1

Radiographic Material A (Control):

Radiographic Material A was a duplitized film having the same blue-light sensitive silver halide emulsion layer on each side of a blue-tinted 170 μm transparent poly(ethylene terephthalate) film support and the same interlayer and overcoat layer over each emulsion layer. The silver halide emulsion layers contained a blend of a 3-dimensional silver iodobromide (97:3 mol %) emulsion and an internally fogged silver bromide emulsion. The silver halide grains were chemically sensitized with sodium thiosulfate, potassium tetrachloroaurate, sodium thiocyanate, and dimethylselenourea. No spectral sensitizing dyes were used and the emulsions of Material A were not prepared using oxidized gelatin.

Radiographic Material A had the following layer arrangement:

Overcoat
Interlayer
Emulsion Layer
Support
Emulsion Layer
Interlayer
Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.28 |

-continued

| | Coverage (mg/dm$^2$) |
|---|---|
| Carboxymethyl casein | 0.73 |
| Colloidal silica (LUDOX AM) | 1.06 |
| Polyacrylamide | 0.53 |
| Chrome alum | 0.025 |
| Resorcinol | 0.058 |
| Spermafol | 0.035 |
| TRITON ® X-200E surfactant | 0.21 |
| LODYNE S-100 surfactant | 0.0015 |
| PLURONIC ® L43 surfactant | 0.0029 |
| Cysteine glutaraldehyde | $1.42 \times 10^{-5}$ |
| Interlayer Formulation | |
| Gelatin vehicle | 3.4 |
| Carboxymethyl casein | 0.73 |
| Colloidal silica (LUDOX AM) | 1.06 |
| Polyacrylamide | 0.53 |
| Chrome alum | 0.025 |
| Resorcinol | 0.058 |
| PLURONIC ® L43 surfactant | 0.0029 |
| Cysteine glutaraldehyde | $1.42 \times 10^{-5}$ |
| Emulsion Layer Formulation | |
| 3-dimensional grain emulsion [AgIBr 1.2 μm avg. dia.] | 21.6 |
| Fogged grain emulsion [AgBr 0.4 μm avg. dia.] | 2.48 |
| Gelatin vehicle | 15.1 |
| 4-Hydroxy-6-methyl-1,3,3a,7-tetraazaindene | 0.8 g/Ag mole |
| Potassium nitrate | 3.81 |
| Maleic acid hydrazide | 1.31 |
| Sorbitol | 1.26 |
| Glycerin | 2.02 |
| 3,5-Disulfocatechol | 4.69 g/Ag mole |
| Carboxymethylcasein | 1.62 |
| Polyacrylamide | 2.7 |
| Dextran | 5.4 |
| Chrome alum | 13.3 g/Ag mole |
| Bisvinylsulfonylmethylether | 0.5% based on total gelatin in all layers |

Radiographic Material B (Control)

Radiographic Material B was a duplitized film having the same green-light spectrally sensitized silver halide emulsion layers on each side of a blue-tinted 170 μm transparent poly(ethylene terephthalate) film support and the same interlayer and overcoat layer over each emulsion layer. The emulsions of Material B were not prepared using oxidized gelatin.

Radiographic Material B had the following layer arrangement:

Overcoat
Interlayer
Emulsion Layer
Support
Emulsion Layer
Interlayer
Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |

-continued

| | Coverage (mg/dm$^2$) |
|---|---|
| Chrome alum | 0.025 |
| Resorcinol | 0.058 |
| Spermafol | 0.15 |
| Interlayer Formulation | |
| Gelatin vehicle | 3.4 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| Tabular grain emulsion [AgBr 2.9 μm avg. dia. × 0.10 μm thickness] | 16.1 |
| Gelatin vehicle | 26.3 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethane | 2% based on total gelatin in all layers on each side |

Radiographic Material C (Invention):

Radiographic Material C was a reflective radiographic material with a single green-light sensitive silver halide emulsion layer disposed on one side only of a reflective support. The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with sulfur, gold, and selenium using conventional procedures. Spectral sensitization to about 560 nm was provided using anhydro-5,5-dichloro-9-ethyl-3,3'-bis(3-sulfopropyl)oxacarbocyanine hydroxide (680 mg/mole of silver) followed by potassium iodide (400 mg/mole of silver).

The reflective support was a resin-coated paper support containing a reflective pigment having the desired reflectance for this invention.

Material C had the following layer arrangement and formulations on the reflective support:

Overcoat
Emulsion Layer
Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |

-continued

| | Coverage (mg/dm$^2$) |
|---|---|
| Tabular grain emulsion [AgBr 4.0 μm avg. dia. × 0.10 μm thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetra-azaindene | 0.03 |
| Hydroquinone | 11.7 |
| 4-methyl-4'-hydroxymethyl-1-phenyl pyrazolidone | 0.1 |
| 2-Propenoic acid, butyl ester, polymer derived from ethenylbenzene, 2-methyl-2-((1-oxo-2-propenyl)-amino)-1-propane-sulfonic acid, monosodium salt and 2-methyl-2-propenamide | 10.0 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Radiographic Material D (Invention):

The layer arrangement and reflective support of Material D were like that for Material C and contained the same green-light sensitive emulsion ingredients and overcoat except that hydroquinone and 4-methyl-4'-hydroxymethyl-1-phenyl pyrazolidone were omitted. The emulsion coated on one side of the reflective support contained a "run-iodide MIF ammonia-ripened oxidized gelatin" having silver iodobromide tabular grains dispersed therein (aspect ratio of 30). The iodide was added during grain growth as a 3.5 mol % vAg-controlling iodobromide salt, starting at the beginning of growth (1.7% of silver run) to 85% of the silver run. This provided iodide in a localized portion of the grains of 1.7 to 85% where 100% refers to the grain surface. The remainder of the emulsion grains was comprised of silver bromide.

Radiographic Material E (Invention):

Material E was a reflective radiographic material with a single blue-light sensitive silver halide emulsion layer disposed on one side only of a reflective support (same as for Material C). The emulsion layer contained tabular silver halide grains that were prepared and dispersed in deionized oxidized gelatin that had been added at multiple times before and/or during the nucleation and early growth of the silver bromide tabular grains dispersed therein. The tabular grains had a mean aspect ratio of about 40. The nucleation and early growth of the tabular grains were performed using a "bromide-ion-concentration free-fall" process in which a dilute silver nitrate solution was slowly added to a bromide ion-rich deionized oxidized gelatin environment. The grains were chemically sensitized with aurousdithiosulfate, sodium thiocyanate, and potassium selenocyanate using conventional procedures. Spectral sensitization to the "blue" (420–480 nm) region was provided using a 50:50 molar blend of spectral sensitizing dyes SS-1 and SS-2 identified below. The total amount of spectral sensitizing dyes was 500 mg per mole of silver.

(SS-1)

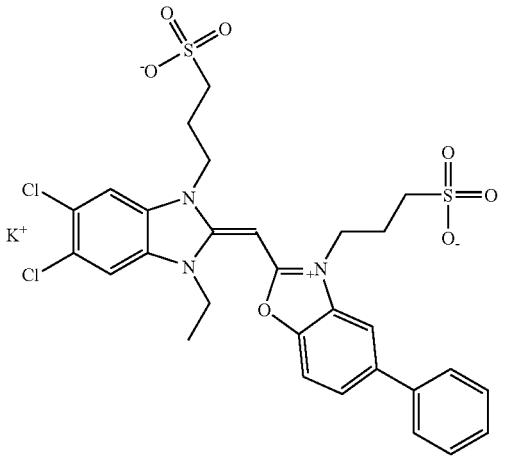

(SS-2)

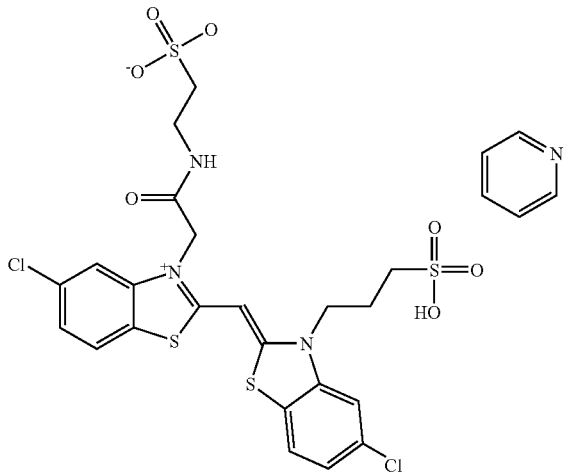

Material E had the following layer arrangement and formulations of the reflective support:

Overcoat

Emulsion Layer

Reflective Support

| | Coverage (mg/dm$^2$) |
|---|---|
| Overcoat Formulation | |
| Gelatin vehicle | 10.8 |
| TRITON ® X-200E surfactant | 0.28 |
| Olin 10G surfactant | 0.74 |
| Emulsion Layer Formulation | |
| Tabular grain emulsion [AgIBr 1.5:98.5 mole halide ratio, 3.0 μm avg. dia. × 0.12 μm thickness] | 16.1 |
| Oxidized gelatin vehicle | 2.5 |
| Non-oxidized gelatin vehicle | 22.8 |
| 5-Bromo-4-hydroxy-6-methyl-1,3,3a,7-tetra-azaindene | 0.03 |
| Hydroquinone | 11.7 |

-continued

| | Coverage (mg/dm$^2$) |
|---|---|
| 4-methyl-4'-hydroxymethyl-1-phenyl pyrazolidone | 0.1 |
| TRITON ® X-200E surfactant | 0.3 |
| Oxiranemethanol, polymer with nonylphenol | 0.9 |
| Bisvinylsulfonylmethane | 3.5% based on total gelatin on imaging side |

Reflective Material F (Invention):

The layer arrangement and reflective support of Material F were like that for Material E and contained the same blue-light sensitive emulsion ingredients and overcoat except that hydroquinone and 4-methyl-4'-hydroxymethyl-1-phenyl pyrazolidone were omitted.

Reflective Material G (Invention):

The layer arrangement and reflective support of Material G were like that for Control Material B except the layer were coated on one side only of the reflective support.

The cassettes used for imaging contained one of the following screens on the imaging side of the noted radiographic material:

Fluorescent intensifying screen "X" was a commercially available green-light emitting KODAK Lanex® Regular Screen. It comprised a terbium activated gadolinium oxysulfide phosphor (median particle size of 7.8 to 8 μm) dispersed in a Permuthane™ polyurethane binder on a white-pigmented poly(ethylene terephthalate) film support. The total phosphor coverage was 4.83 g/dm$^2$ and the phosphor to binder weight ratio was 19:1. The speed of this screen was 400.

Fluorescent intensifying screen "Y" was a commercially available green-light emitting KODAK Lanex® Fast Screen package of two asymmetric screens, one for the frontside (imaging side) and one for the backside. Each screen comprised a terbium activated gadolinium oxysulfide phosphor layer on a white-pigmented poly(ethylene terephthalate) film support. The phosphor in each layer (median particle size of about 7.9 μm) was dispersed in a Permuthane™ polyurethane binder. The total phosphor coverage in the screen used on the frontside ("exposed side") was 4.83 g/dm$^2$ and the total phosphor coverage in the screen used on the backside was 13.5 g/dm$^2$. The phosphor to binder weight ratio for each screen was 19:1. The speed of the frontside screen was 600.

Fluoresecent intensifying screen "W" was a commercially available green-light emitting KODAK Lanex® Fast Back Screen that is the backside screen used for the package of screens identified as "Y" above. It comprised a terbium activated gadolinium oxysulfide phosphor having a median particle size of 8 μm coated on a white pigmented polyester support in a Permuthane™ polyurethane binder at a total phosphor coverage of 13.3 g/dm$^2$ at a phosphor to binder ratio of 19:1. The speed of this screen was 800.

Fluorescent intensifying screen "V" was a commercially available blue-light emitting DuPont Hi Plus Screen. It comprised a calcium tungstate phosphor layer. The speed of this screen was 100.

Fluorescent intensifying screen "Z" contained a blue-light emitting europium activated barium fluorobromide as the phosphor having a median particle size of 6 μm coated on a blue-dyed polyester support in a Permuthane™ polyurethane binder at a total phosphor coverage of 3.84 g/dm$^2$ at a phosphor to binder ratio of 19:1. The speed of this screen was 400.

Samples of the reflective radiographic materials were exposed using an inverse square X-ray sensitometer (device that makes exceedingly reproducible X-ray exposures). A lead screw moved the detector between exposures. By use of the inverse square law, distances were selected that produced exposures that differed by 0.100 logE. The length of the exposures was constant. This instrument provided sensitometry that gives the response of the detector to an imagewise exposure where all of the image is exposed for the same length of time, but the intensity is changed due to the anatomy transmitting more or less of the X-radiation flux.

The exposed samples of Radiographic Materials A, B, and C were processed using a commercially available KODAK RP X-OMAT® Film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

Fixing was carried out using KODAK RP X-OMAT® LO Fixer and Replenisher fixing composition (Eastman Kodak Company). The samples were processed in the developer for less than 90 seconds and the total processing time was about 90 seconds ("dry-to-dry").

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic density vs. logE curve was plotted for each radiographic material that was exposed and processed as noted above. System speed was measured as noted above at a density of 1.0+$D_{min}$.

The following TABLE I shows the sensitometric data for the Control and Invention radiographic materials. The data show that the three Control materials represent a range of state of the art "system" speeds for radiography. Invention Material C, however, provided a "system" speed that was 4 to 32 times faster. This enables the use of Radiographic Material C with low-power X-radiation generating machines. In addition, the use of a reflective support enables viewing the image of Radiographic Material C without a light box. Invention Materials D, E, and F also provided increased system speed compared to the Control Materials using the same screens and images can be viewed without a light box.

TABLE I

| Radiographic Material | Screen | System Speed |
|---|---|---|
| A (Control) | V | 100 |
| B (Control) | X | 400 |
| B (Control) | Y | 800 |
| C (Invention) | W | 3200 |
| D (Invention) | V | 200 |
| E (Invention) | Z | 800 |
| F (Invention) | | |
| G (Invention) | | |

The invention has been described in detail with particular reference to preferred embodiments thereof, but it will be understood that variations and modifications can be effected within the spirit and scope of the invention.

The invention claimed is:

1. A reflective radiographic material having a speed of at least 200 and comprising a reflective support that has first and second major surfaces, said reflective radiographic material having disposed on said first major reflective support surface only, one or more hydrophilic colloid layers including a silver halide emulsion layer.

2. The material of claim 1 wherein said reflective support is a resin-coated paper support.

3. The material of claim 1 wherein said silver halide emulsion layer comprises tabular silver halide grains that have an aspect ratio of at least 25, an average grain diameter of at least 2.5 μm, an average thickness of from about 0.07 to about 0.12 μm, and comprise at least 90 mol % bromide and up to 5 mol % iodide, both based on total silver in said grains.

4. The material of claim 1 wherein said silver halide emulsion layer comprises tabular silver halide grains having at least 95 mol % bromide and up to 3 mol % iodide, both based on the total silver in said grains.

5. The material of claim 3 wherein said tabular silver halide grains have an aspect ratio of from about 25 to about 45, and an average grain diameter of from about 2.5 to about 4.5 μm, and an average thickness of from about 0.07 to about 0.11 μm.

6. The material of claim 1 wherein said silver halide emulsion layer comprises silver halide grains that are dispersed in a hydrophilic polymeric vehicle mixture comprising at least 0.05% of oxidized gelatin, based on the total dry weight of said hydrophilic polymeric vehicle mixture.

7. The material of claim 6 wherein said silver halide emulsion layer comprises silver halide grains that are dispersed in a hydrophilic polymeric vehicle mixture comprising from about 0.1 to about 1.5% of oxidized gelatin, based on the total dry weight of said hydrophilic polymeric vehicle mixture.

8. The material of claim 1 having a total silver coverage of at least 13 and up to 18 mg/dm$^2$, and the amount of polymer vehicle on said first major reflective support surface is from about 36 to about 40 mg/dm$^2$.

9. The material of claim 1 comprising a single silver halide emulsion layer on said first major reflective support surface.

10. The material of claim 1 wherein said support comprises a microvoided continuous polyester first phase and a second phase dispersed within the continuous polyester first phase, said second phase comprising microvoids containing barium sulfate particles.

11. The material of claim 1 further comprising a protective overcoat disposed over said one or more hydrophilic colloid layers including a silver halide emulsion layer.

12. A reflective radiographic material having a speed of at least 800 and comprising a reflective resin-coated paper support that has first and second major surfaces, said reflective radiographic material having disposed on said first major reflective support surface, two or more hydrophilic colloid layers including a single silver halide emulsion layer, said single silver halide emulsion layer comprising tabular silver halide grains that have an aspect ratio of from about 25 to about 40, an average grain diameter of from about 2.5 to about 4.5 μm, and an average thickness of from about 0.07 to about 0.11 μm, and comprise at least 95 mol % bromide and up to 1 mol % iodide, both based on total silver in said grains, said material optionally comprising a protective overcoat disposed over all of said hydrophilic colloid layers, wherein said tabular silver halide grains in said silver halide emulsion layer are dispersed in a hydrophilic polymeric vehicle mixture comprising from about 0.1 to about 1.5% of deionized oxidized gelatin, based on the total dry weight of said hydrophilic polymeric vehicle mixture, the coverage of silver in said silver halide emulsion layer is from about 15 to about 18 mg/dm and the polymer vehicle coverage in said silver halide emulsion layer on said first major reflective support surface of from about 38 to about 40 mg/dm$^2$.

13. An imaging assembly that has a system speed of at least 200 and comprises:

A) a radiographic material of claim 1, and

B) a fluorescent intensifying screen or storage phosphor panel arranged on the imaging side of said radiographic material, said screen or panel having a screen speed of at least 100 and comprising an inorganic phosphor capable of absorbing X-rays and emitting electromagnetic radiation having a wavelength greater than 300 nm, said inorganic phosphor being coated in admixture with a polymeric binder in a phosphor layer onto a support.

14. The imaging assembly of claim 13 having a system speed of at least 800 wherein said radiographic material has a film speed of at least 800 and said fluorescent intensifying screen has a screen speed of at least 400.

15. A method of providing a black-and-white image comprising processing an exposed reflective radiographic material of claim 1 to provide a black-and-white image.

16. The method of claim 15 comprising exposing said reflective material with a fluorescent intensifying screen.

17. The method of claim 15 further comprising using said black-and-white image for a medical diagnosis.

18. The method of claim 15 wherein an image is obtained in said reflective radiographic material using less than 130 kVp power source of X-radiation.

* * * * *

UNITED STATES PATENT AND TRADEMARK OFFICE

CERTIFICATE OF CORRECTION

PATENT NO. : 7,018,770 B1
APPLICATION NO. : 11/091609
DATED : March 28, 2006
INVENTOR(S) : Dickerson et al.

It is certified that error appears in the above-identified patent and that said Letters Patent is hereby corrected as shown below:

TITLE Page of Patent
add Assignee information -- Eastman Kodak Company, Rochester, NY (US) --

Column 24, line 23, Claim 12
delete "18 mg/dm" and replace with -- 18 mg/dm$^2$ --.

Signed and Sealed this

Twenty-eighth Day of November, 2006

JON W. DUDAS
*Director of the United States Patent and Trademark Office*